US006681519B2

(12) United States Patent
Cone

(10) Patent No.: US 6,681,519 B2
(45) Date of Patent: Jan. 27, 2004

(54) SELF-CLAMPING CHRISTMAS TREE STAND

(75) Inventor: Richard E. Cone, Athens, OH (US)

(73) Assignee: Donald F. Mitchell, Paso Robles, CA (US)

( * ) Notice: Subject to any disclaimer, the term of this patent is extended or adjusted under 35 U.S.C. 154(b) by 0 days.

(21) Appl. No.: 10/280,616

(22) Filed: Oct. 24, 2002

(65) Prior Publication Data

US 2003/0084607 A1 May 8, 2003

Related U.S. Application Data

(60) Provisional application No. 60/335,946, filed on Oct. 24, 2001.

(51) Int. Cl.[7] ..... A47G 33/12; A47G 7/02

(52) U.S. Cl. ..... 47/40.5; 47/42; 47/41.01; 47/41.12; 47/41.14; 47/41.15; 248/519; 248/523; 248/526; 248/539; 248/540; 248/541; D11/130.1

(58) Field of Search ..... 47/40.5, 41.01, 47/41.12, 41.14, 41.15, 42; 248/519, 523, 526, 539, 540, 541; D11/130.1

(56) References Cited

U.S. PATENT DOCUMENTS

| | | | | |
|---|---|---|---|---|
| 1,644,807 A | * | 10/1927 | Zeigler | |
| 2,237,513 A | * | 4/1941 | Timko | |
| 2,464,593 A | * | 3/1949 | Lorenzen | |
| 2,592,561 A | | 4/1952 | Greenwood | 248/48 |
| 2,609,169 A | | 9/1952 | Kroeger | 248/48 |
| 2,657,888 A | * | 11/1953 | Ericson | |
| 2,681,780 A | | 6/1954 | Santoro | 248/45 |
| 2,847,175 A | | 8/1958 | Farley et al. | 248/45 |
| 3,301,512 A | | 1/1967 | Nyberg | 248/44 |
| 3,302,909 A | | 2/1967 | Glassman | 248/44 |
| 4,007,901 A | | 2/1977 | Mancini et al. | 248/526 |
| 4,261,138 A | | 4/1981 | St. George Syms | 47/40.5 |
| 4,771,978 A | | 9/1988 | Lofquist et al. | 248/526 |
| 4,825,586 A | | 5/1989 | Coppedge | 47/40.5 |
| 4,834,335 A | | 5/1989 | Attar | 248/526 |
| 4,913,395 A | | 4/1990 | Juhas | 248/516 |
| 4,949,502 A | | 8/1990 | Anderson | 47/40.5 |
| 4,976,411 A | | 12/1990 | Gordon et al. | 248/524 |
| 4,989,820 A | | 2/1991 | Sterling | 248/523 |
| 5,000,414 A | * | 3/1991 | Rosato | 248/524 |
| 5,002,252 A | | 3/1991 | Setala et al. | 248/533 |
| 5,114,113 A | | 5/1992 | Krinner | 248/525 |
| 5,118,067 A | | 6/1992 | Gillanders | 248/527 |
| D328,042 S | | 7/1992 | Lai | D11/130.1 |
| D330,346 S | | 10/1992 | Bryand | D11/130.1 |
| 5,160,110 A | | 11/1992 | Praegitzer | 248/523 |
| 5,195,715 A | | 3/1993 | Cone | 248/526 |
| 5,249,772 A | | 10/1993 | Montie, Jr. et al. | 248/523 |
| 5,375,808 A | | 12/1994 | Roy | 248/523 |
| 5,398,444 A | | 3/1995 | Murray | 47/40.5 |

(List continued on next page.)

FOREIGN PATENT DOCUMENTS

| | | | | |
|---|---|---|---|---|
| DE | 3609357 | * | 3/1986 | A47G/33/12 |

*Primary Examiner*—Peter M. Poon
*Assistant Examiner*—Andrea M. Valenti
(74) *Attorney, Agent, or Firm*—Philip A. Steiner

(57) ABSTRACT

A self-clamping Christmas tree stand provides a stable platform for a Christmas tree that allows simple installation and adjustment of the tree angle without having to be positioned under the tree to perform the adjustments. The tree stand uses the weight of the tree to firmly clamp the tree's trunk. A clamping mechanism provides a constant grip that will not loosen unless an upward force is provided by the user. The adjustment range of the tree trunk angle with respect to the vertical plane may be varied to accommodate tree trunks of different shapes. Lastly, the tree stand includes a large liquid reservoir to maintain the tree's moisture content.

15 Claims, 3 Drawing Sheets

U.S. PATENT DOCUMENTS

| | | | | |
|---|---|---|---|---|
| 5,467,959 | A | 11/1995 | Behringer | 248/523 |
| D364,831 | S | 12/1995 | Fillipp | D11/130.1 |
| 5,507,117 | A | 4/1996 | Kalman et al. | 47/40.5 |
| 5,779,215 | A | 7/1998 | DeMasi | 248/523 |
| 5,791,626 | A | 8/1998 | Reese | 248/523 |
| 5,797,579 | A | 8/1998 | Krinner | 248/523 |
| 5,893,547 | A | 4/1999 | Cohen, Jr. | 248/521 |
| 6,012,698 | A | 1/2000 | Hardt et al. | 248/523 |
| 6,019,341 | A | 2/2000 | Brown et al. | 248/516 |
| 6,087,946 | A | 7/2000 | Menard, Jr. | 340/618 |
| 6,094,859 | A | 8/2000 | Kalman et al. | 47/40.5 |
| 6,095,480 | A | 8/2000 | Mutschler | 248/523 |
| 6,129,325 | A | 10/2000 | Niklas | 248/523 |
| 6,155,529 | A | 12/2000 | De Carlo | 248/523 |
| 6,216,997 | B1 | 4/2001 | Short | 248/523 |
| D444,412 | S | 7/2001 | Krinner et al. | D11/130.1 |

* cited by examiner

SELF-CLAMPING CHRISTMAS TREE STAND

CROSS-REFERENCE TO RELATED APPLICATIONS

This application is a non-provisional application claiming benefit and priority from U.S. provisional application No. 60/335,946 filed on Oct. 24, 2001.

FEDERALLY SPONSORED RESEARCH AND DEVELOPMENT

Not Applicable.

REFERENCE TO A MICROFICHE APPENDIX

Not Applicable.

FIELD OF THE INVENTION

This invention relates to a stand for maintaining a cut tree in a vertical position and more specifically to a Christmas tree stand.

BACKGROUND

Tree stands are known in the relevant art, including U.S. Pat. No. 5,195,715 (Cone) to the present inventor and assignee (Mitchell.) Desirable features of a tree stand are low cost; ease of assembling a tree in the stand in a vertical position, even an imperfect tree with an asymmetric and crooked tree trunk; stability, both in having a sufficient footprint to prevent tipping of the tree, and in providing a gripping force on the tree trunk sufficient to retain the tree in the desired position and; provision to maintain the tree bottom immersed in a liquid reservoir of water or water-preservative mixture, to minimize degradation of the tree. It is further desirable that the liquid reservoir be large enough so it only requires replenishment on an infrequent basis.

Some relevant art references establish the grip on a tree trunk by a mechanical mechanism that uses a device that is manually tightened at initial installation. There are numerous examples of such stands, U.S. Pat. No. 4,913,395 (Juhas), U.S. Pat. No. 5,114,113 (Krinner), U.S. Pat. No. 5,249,772 (Montle), U.S. Pat. No. 5,375,808 (Roy), U.S. Pat. No. 5,398,444 (Murray), U.S. Pat. No. 5,467,959 (Behringer), U.S. Pat. No. 5,779,215 (DeMasi) and U.S. Pat. No. 6,129,325 (Niklas) provide recent examples illustrating the complexity and resulting high cost of such mechanisms. Most of these mechanisms are inconvenient because they require the tree installer to tighten the stand mechanism with the tree lying horizontal, or the installer must lie under the tree when in the vertical position to tighten it. Neither of these options allows the installer to view the tree to assure it is vertical.

One reference U.S. Pat. No. 5,375,808 (Roy) has provision for adjusting the tree and then tightening the stand mechanism while standing beside the tree but this mechanism requires the tree installer to exert considerable downward force on the operating mechanism at a location adjacent to the tree trunk. This is a difficult action to perform if the tree has substantial lower branches near the bottom of the trunk.

An improvement to mechanisms requiring tightening at initial installation is to use the weight of the tree to provide the grip on the tree trunk, and design the mechanism so the gripping force is always present as long as the tree is in the stand. Stands with this type of mechanism allow the tree angle to be adjusted by lifting on the tree to release the gripping force, adjust the angle and then lower the tree. U.S. Pat. No. 2,464,593 (Lorenzen) describes a tree holder in which the tree weight rests on a spring-supported conical cup. The motion of the cup due to the tree weight causes knife-edge gripping blades to grip and support the tree trunk. U.S. Pat. No. 2,592,561 (Greenwood) describes a stand in which the tree weight is supported on movable jaws that rotate to grip the tree trunk when the tree is installed in the stand. U.S. Pat. No. 3,301,512 (Nyberg) shows a stand in which the weight of the inserted tree acts through a lever mechanism to grip the tree trunk with several clamps. U.S. Pat. No. 4,007,901 (Mancini) shows a stand in which the weight of the tree in a central reservoir causes three legs to pivot and cause their upper, clamping collars to grip the tree. This stand uses a three-point support using narrow legs, which is not as stable as a circular, flat-bottomed stand, and it uses an non-adjustable lower support spike that makes adjustment of the angle to the vertical of a tree difficult if not impossible.

The complexity of these mechanisms and resulting high cost to manufacture and assemble the stands are detrimental to the use of such mechanisms. Therefore, what is needed is a stand that can be economically manufactured and assembled yet provides for easy installation of all types of trees and provides ease of adjustment of the tree angle, stability of the tree, stability of the tree angle, and an ample liquid reservoir to maintain the tree in prime condition.

SUMMARY AND OBJECTS OF THE INVENTION

The present invention is directed to an Christmas Tree that satisfies the above identified needs. The Christmas tree stand is constructed of molded plastic or equivalent organic polymeric materials and comprises a reservoir member, a base member, several clamping members and a spiked stabilizer disk.

The reservoir member provides a liquid tight volume for providing nourishment to the tree and includes an opening for receiving a trunk of a tree into the interior volume. The tree trunk is inserted into interior volume until it directly or indirectly engages a substantially centered stabilizer positioning dowel. The lower piston portion of the reservoir member is coaxially inserted into a centered cylinder portion associated with the base member. An upper flange portion of the reservoir includes a number of equally spaced slots for receiving therethrough an equal number of clamping members. When engaged with the reservoir member, the weight of the tree forces the reservoir member downward, causing a portion of this force to be transferred to the clamping members. The clamping members are thereby compressively driven against the tree trunk providing a clamping force sufficient to maintain the tree in a vertical position.

The base member includes the cylinder portion described above, an outer support portion having equally spaced pivot channels in angular alignment with the slots associated with the reservoir member. A rim is provided on the outer circumference of the base member for capturing incidental spills of liquids. A spring may be placed in the cylinder portion to provide a counterforce to the weight of the tree being supported by the reservoir member.

Each of the clamping members include a pivot end for being pivotally supported by the pivot channels included in the base member, a curvilinear end having a substantially vertical face which is used in clamping the tree trunk, an engagement notch for slideably locking the upper flange portion of the reservoir member into a clamped position, and an upper travel stop for limiting travel of said reservoir member in an upward direction during repositioning of the tree or when no tree is present in the stand.

The spiked stabilizer disk includes a top portion having one or more vertically standing spike for impaling the bottom of the tree trunk and a bottom portion having a plurality of indentations for adjustably coupling with the stabilizer positioning dowel installed at the bottom of the reservoir member. The plurality of indentations allows for repositioning of the tree to accommodate for misalignments of the tree trunk with respect to a vertical axis. In difficult installations, the stabilizer disk may be trimmed using scissors to further accommodate misalignments of said tree trunk.

BRIEF DESCRIPTION OF THE SEVERAL VIEWS OF THE DRAWINGS

The features and advantages of the invention will become apparent from the following detailed description when considered in conjunction with the accompanying drawings. Where possible, the same reference numerals and characters are used to denote like features, elements, components or portions of the invention. It is intended that changes and modifications can be made to the described embodiment without departing from the true scope and spirit of the subject invention as defined in the claims.

DETAILED DESCRIPTION

Figure 1:
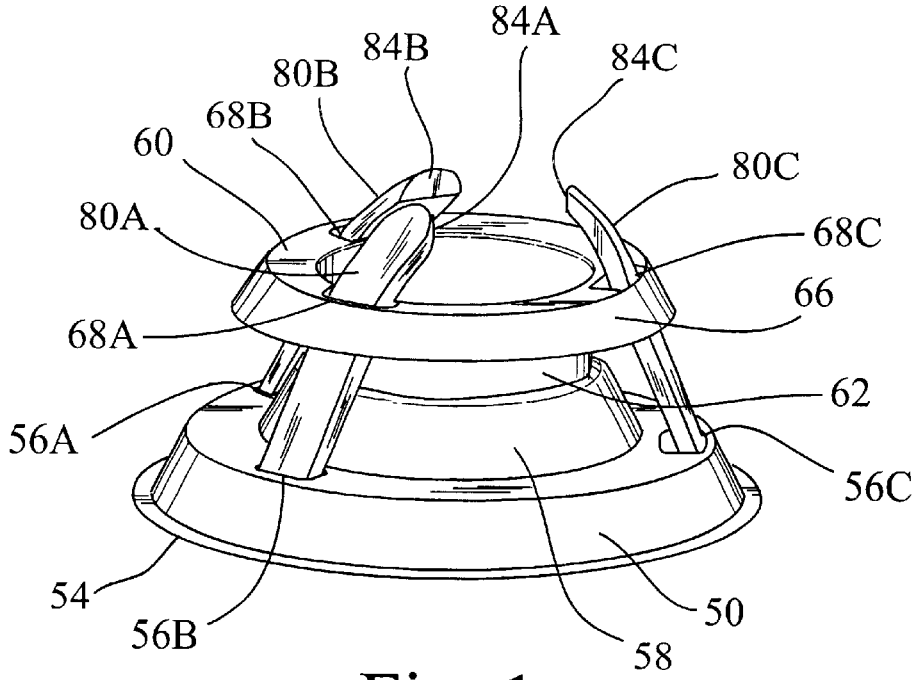
FIG. 1 is a perspective view of the self-clamping Christmas tree support stand.

FIG. 1 depicts the self-clamping Christmas tree support stand. The tree stand is constructed of molded plastic or equivalent organic polymer material and is comprised of a base member 50, a reservoir member 60, and 3 curvilinear clamping members 80A, 80B, 80C.

The base member 50 is comprised of an outer support portion 54 having an upward facing rim to capture incidental water spills, three equally spaced (circumferentially and radially) pivot channels 56A, 56B, 56C and a cylindrical portion 58 for coaxially mounting the reservoir member 60. The three pivot channels 56A, 56B, 56C receive the lower ends of the clamping members 80A, 80B, 80C maintain the clamping members in a substantially vertical position and allows the clamping members to pivot back and forth in a radial direction.

The reservoir member 60 is comprised of a piston portion 62 and a flange portion 66. The piston portion 62 is coaxially mounted inside the cylindrical portion 58 of the base member 50 and slides along the cylindrical portion 58 in a downward direction when the clamping members 80A, 80B, 80C engage a tree trunk. The flange portion 66 includes 3 equally spaced (circumferentially and radially) slots 68A, 68B, 68C aligned with the three equally spaced recesses 56A, 56B, 56C of the base member 50 through which the clamping members 80A, 80B, 80C extend.

Figure 2:
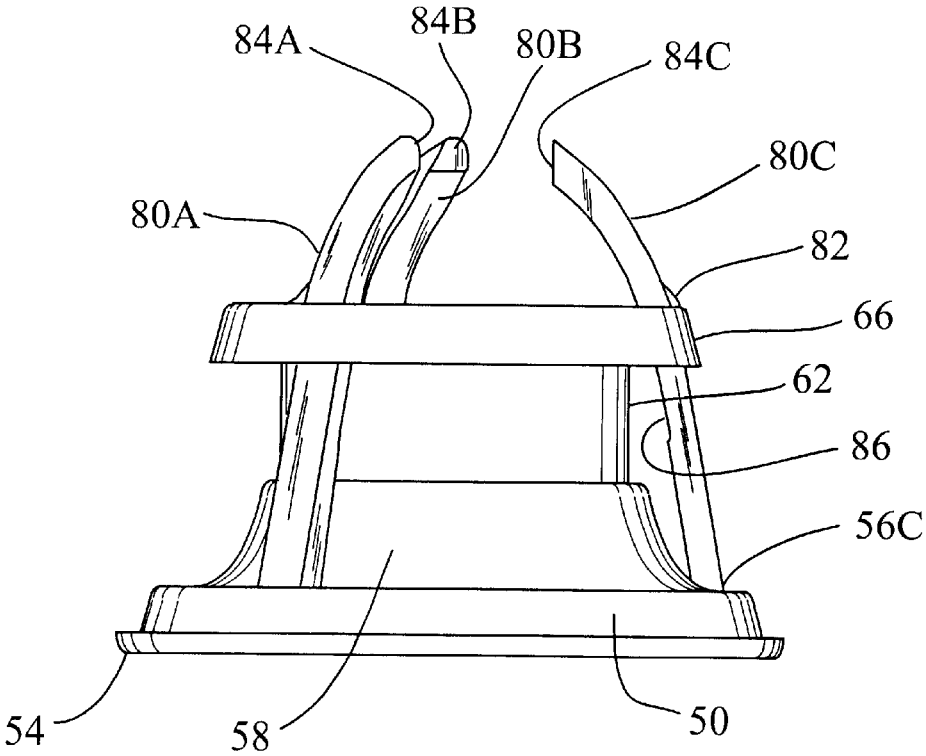
FIG. 2 is a side view of the self-clamping Christmas tree support stand.

Each of the clamping members 80A, 80B, 80C, includes a substantially vertical face 84A, 84B, 84C for engaging a tree trunk, an upper travel stop 82 and an engagement notch 86. The upper travel stop 82 sets the maximum circumference of a tree trunk which can be accommodated by the tree stand. The engagement notch 86 assists in securely locking the clamping members 80A, 80B, 80C to the tree truck. While only one upper travel stop 82 and engagement notch 86 is visible in FIG. 2, each of the clamping members 80A, 80B, 80C include these features.

Figure 3:
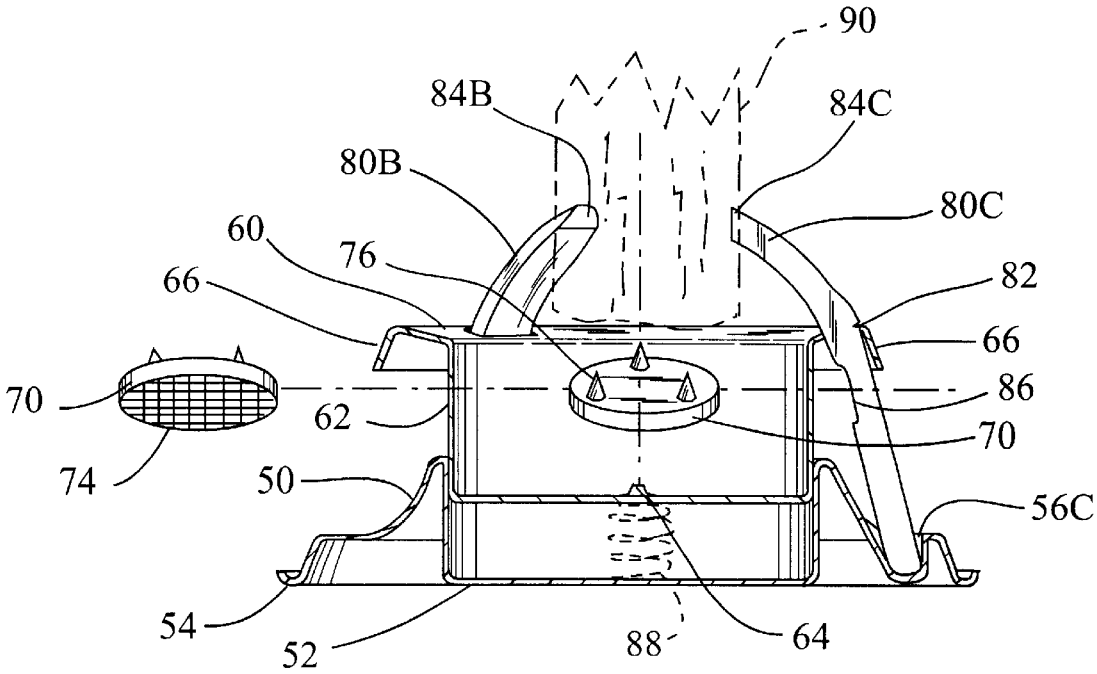
FIG. 3 is a sectional view of the self-clamping Christmas tree stand illustrating the top and bottom of a stabilizer disk and its assembly on a positioning dowel as the stand is clamping onto a tree trunk.

Referring to FIG. 3, a sectional cutout view depicts an enclosed flat bottom 52 of the cylinder portion 58 portion of the base member 50. The flat bottom 52, in cooperation with the outer support portion 54 provides a stable support platform that will maintain a tree in a substantially vertical position when placed on a reasonably level floor. The outer support portion 54 extends the area of the stand in contact with the floor, which improves stability against tipping of the tree.

The piston portion 62 of the reservoir member 60 obtains lateral support from the base member 50 when coaxially inserted into the cylinder portion 58. The interior volume of the piston portion 62 includes a liquid tight volume and provides a large liquid reservoir for providing nourishment to the supported tree. The interior bottom of the reservoir member 60 includes a stabilizer positioning dowel 64 for positioning of a stabilizer disk 70.

The stabilizer disk 70 includes one or more spikes 76 located about the top surface of the stabilizer. The spikes become embedded in the bottom of the tree trunk 90 as the trunk is inserted into the stand. The underside of the stabilizer disk 70 includes a plurality of indentations 74 which allows coupling of the stabilizer disk 70 to the stabilizer positioning dowel 64.

The plurality of indentations 74 accommodate repositioning of the tree trunk 90 to compensate for variations in tree geometries. To adjust the position of the tree, the tree 90 is lifted slightly to remove the stabilizer grid disk from the positioning dowel and to relax the clamping force of the clamps.

The tree's angle may then be adjusted and lowered to reposition the stabilizer disk 70 into a different indentation 74 with the positioning dowel 64. In an alternate embodiment of the invention, the stabilizer disk 70 is eliminated and the positioning dowel 64 replaced by at least one spike.

The flange portion 66 of the reservoir member 60 contacts the upper travel stop 82 which sets the maximum circumference of the tree trunk 90 which can be accommodated by the tree stand. The flange portion 66 of the reservoir member 60 also provides a positive lock when the flange portion 66 is driven downward past the engagement notches 86 associated with each of the clamping members 80A, 80B, 80C by the weight of the tree 90. The offset inner surfaces of the engagement notches 86 straddle the flange portion 66 of the reservoir member 60 preventing the clamping members 80A, 80B, 80C from returning to their unlocked positions. In another embodiment of the invention, a spring 88 is placed interstitially between the piston portion 62 and the cylinder portion 58 to provide a counter-force for returning the piston portion 62 to its initial position.

Figure 4:
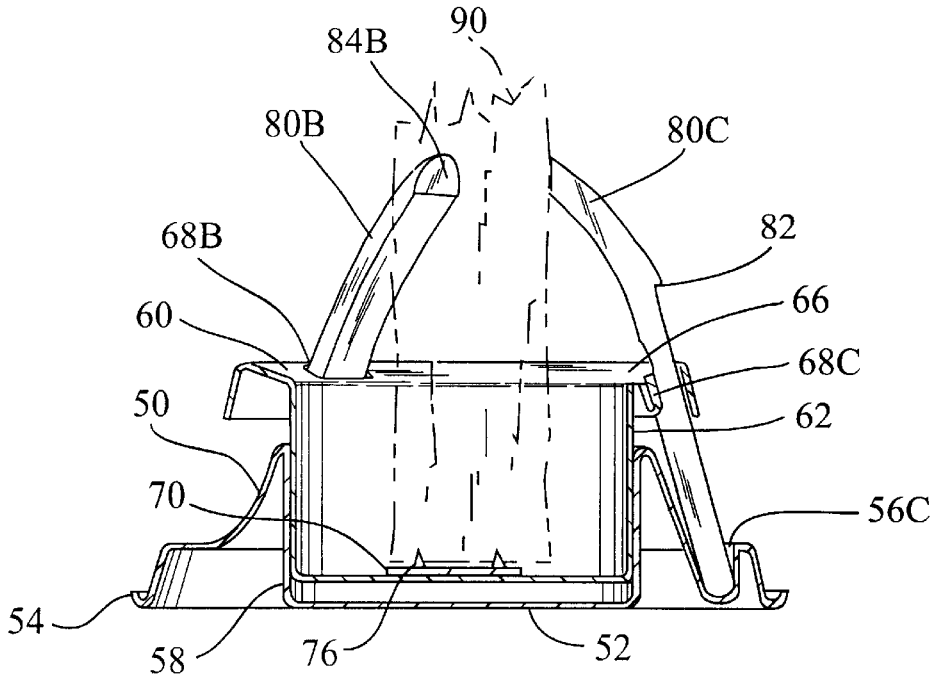
FIG. 4 is another sectional view of the self-clamping Christmas tree stand of illustrating the tree trunk fully seated within a reservoir member and engaged with the stabilizer disk.

In FIG. 4, another sectional view of the stand illustrates the final engaged positions of the reservoir member 60, the piston portion 62 inside the cylinder portion 58 and the locking mechanism where the flange portion 66 is held in relative position by the engagement notches 86 associated with each of the clamping members 80A, 80B, 80C.

Figure 5:
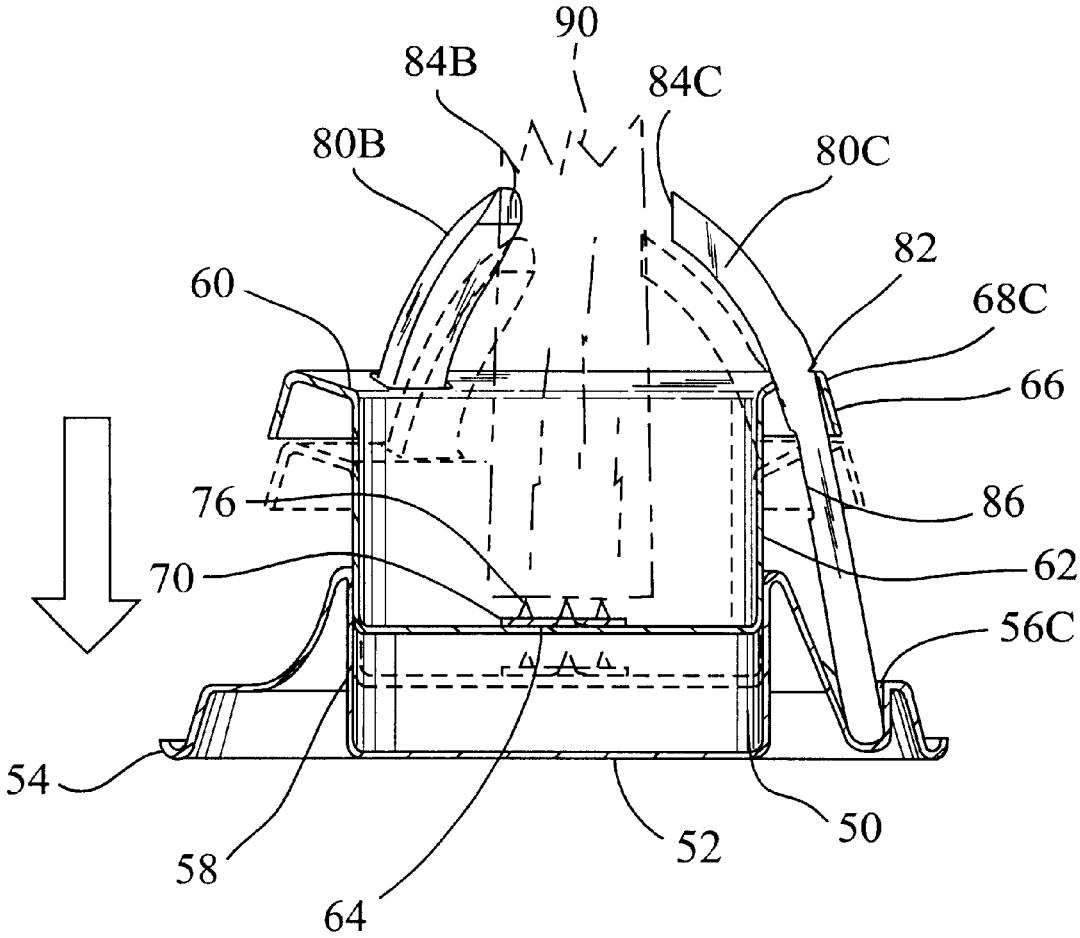
FIG. 5 is a cutaway sectional view of the self-clamping Christmas tree stand illustrating a clamping action driven by engagement of the tree trunk with a coaxially mounted reservoir member.

Referring to FIG. 5, when a tree trunk 90 is inserted into the stand, the piston portion 62 is forced into the cylinder portion 58 by the weight of the tree and held in place by the clamping members 80A, 80B, 80C. The downward force exerted by the weight of the tree causes the clamping members 80A, 80B, 80C to pivot radially inward until the vertical faces 84A, 84B, 84C contact and position the tree trunk 90. The weight of the tree on the piston portion 62 is transmitted at the slots 68A, 68B, 68C which act as fulcrum points, providing a constant clamping force on the tree trunk.

In use, the self-clamping Christmas tree stand base member 50 is placed on a reasonably level surface in a location where it is desired to display the Christmas tree. The reservoir member 60 is partially inserted into the cylinder portion 58 of the base member 50 with the slots 68A, 68B, 68C included in the flange portion 66 openings aligned with the base member 50 pivot channels 56A, 56B, 56C. A stabilizer disk 70 is inserted in the reservoir with the spikes facing up. The 3 clamping members 80A, 80B, 80C are inserted into the slots 68A, 68B, 68C and bottomed in the pivot channels pivot channels 56A, 56B, 56C with the vertical faces 84A, 84B, 84C ends up.

The tree trunk bottom 90 is cut square with the desired vertical axis of the tree, and branches are removed from the trunk to provide a bare trunk at least to the distance the stand clamp tree grips are from the floor. The tree is then placed upright over the stand, lowered between the clamps into the reservoir member 60, and firmly impaled on the stabilizer spikes 76 so they attach the bottom of the trunk to the stabilizer. The tree is now supported by the stand.

If the tree is at an objectionable angle to the vertical, adjust the angle by lifting the tree slightly, shifting it in the desired direction and lowering it. This may need to be repeated, with smaller adjustments, to get the tree in the desired position. If the tree cannot be adjusted to an acceptable angle, the tree should be removed and the stabilizer disk 70 removed from the bottom of the tree trunk. The lower stabilizer circumference should be trimmed approximately ¼ inch in radius completely around the circumference. The stabilizer disk should then be reinstalled in the reservoir member 60 with the spike 76 facing up and the tree installation procedure repeated. When the tree is at the desired angle, the reservoir should be filled with water or a preservative solution.

The foregoing described embodiments of the invention are provided as illustrations and descriptions. They are not intended to limit the invention to the precise form described. Other variations and embodiments are possible in light of above teachings, and it is not intended that this Detailed Description limit the scope of invention, but rather by the Claims following herein.

REFERENCES

| U.S. Pat. No. Citations | Inventor | Date of Patent |
|---|---|---|
| 1. 2,237,513 | Timko | Apr. 8, 1941 |
| 2. 2,464,593 | Lorenzen | Mar. 13, 1949 |
| 3. 2,592,561 | Greenwood | Apr. 15, 1952 |

-continued

REFERENCES

| U.S. Pat. No. Citations | Inventor | Date of Patent |
|---|---|---|
| 4. 2,609,169 | Kroeger | Sep. 2, 1952 |
| 5. 2,681,780 | Santoro | Jun. 22, 1954 |
| 6. 2,847,175 | Farley et al. | Aug. 12, 1958 |
| 7. 3,301,512 | Nyberg | Jan. 31, 1967 |
| 8. 3,302,909 | Glassman | Feb. 7, 1967 |
| 9. 4,007,901 | Mancini et al. | Feb. 15, 1977 |
| 10. 5,261,138 | St. George Syms | Apr. 14, 1981 |
| 11. 4,771,978 | Lofquist et al. | Sep. 20, 1988 |
| 12. 4,825,586 | Coppedge | May 2, 1989 |
| 13. 4,834,335 | Attar | May 30, 1989 |
| 14. 4,913,395 | Juhas | Apr. 3, 1990 |
| 15. 4,949,502 | Anderson | Aug. 21, 1990 |
| 16. 4,976,411 | Gordon et al. | Dec. 11, 1990 |
| 17. 4,989,820 | Sterling | Feb. 5, 1991 |
| 18. 5,002,252 | Setala et al. | Mar. 26, 1991 |
| 19. 5,114,113 | Krinner | May 19, 1992 |
| 20. 5,118,067 | Gillanders | Jun. 2, 1992 |
| 21. D328042 | Lai | Jul. 21, 1992 |
| 22. D330346 | Bryand | Oct. 20, 1992 |
| 23. 5,160,110 | Praegitzer | Nov. 3, 1992 |
| 24. 5,195,715 | Cone | Mar. 23, 1993 |
| 25. 5,249,772 | Montie Jr. et al. | Oct. 5, 1993 |
| 26. 5,375,808 | Roy | Dec. 27, 1994 |
| 27. 5,398,444 | Murray | Mar. 21, 1995 |
| 28. 5,467,959 | Behringer | Nov. 21, 1995 |
| 29. D364831 | Fillipp | Dec. 5, 1995 |
| 30. 5,507,117 | Kalman et al. | Apr. 16, 1996 |
| 31. 5,791,215 | DeMasi | Jul. 14, 1998 |
| 32. 5,791,626 | Reese | Aug. 11, 1998 |
| 33. 5,797,579 | Krinner | Aug. 25, 1998 |
| 34. 5,893,547 | Cohen, Jr. | Apr. 13, 1999 |
| 35. 6,012,698 | Hardt et al. | Jan. 11, 2000 |
| 36. 6,019,341 | Brown et al. | Feb. 1, 2000 |
| 37. 6,087,946 | Menard, Jr. | Jul. 11, 2000 |
| 38. 6,094,859 | Kalman, et al. | Aug. 1, 2000 |
| 39. 6,095,480 | Mutschler | Aug. 1, 2000 |
| 40. 6,129,325 | Niklas | Oct. 10, 2000 |
| 41. 6,155,529 | De Carlo | Dec. 5, 2000 |
| 42. 6,216,997 | Short | Apr. 17, 2001 |
| 43. D444412 | Krinner et al. | Jul. 3, 2001 |

I claim:

1. A self-clamping Christmas tree stand comprising:

a reservoir member including, (a) an opening for receiving a trunk of a tree, (b) an upper portion including slots receiving a plurality of self-clamping members there through, (c) a lower portion for coaxially disposing said reservoir member into a base member, and (d) means for causing said plurality of self-clamping members to clamp onto said tree trunk when a weight associated with said tree is applied to said reservoir member;

said base member including, (a) a central portion adapted for coaxially receiving said lower portion of said reservoir member, and (b) an outer portion adapted for receiving said plurality of self-clamping members; and, said plurality of self-clamping members, each of said plurality of self-clamping members including, (a) a bottom end adapted for being disposed into said outer portion of said base member, (b) a top end adapted for clamping onto said tree trunk, and (c) means for locking said reservoir member into a clamped position following application of said weight.

2. The self-clamping Christmas free stand according to claim 1, wherein said reservoir member further includes an interior bottom, said interior bottom including a substantially centered stabilizer positioning dowel.

3. The self-clamping Christmas tree stand according to claim 2, further including a stabilizer disk, said stabilizer disk including;

(a) a top portion having at least one vertically standing spike for impaling a bottom of said tree trunk, and (b) a bottom portion having a plurality of indentations for adjustably coupling with said stabilizer positioning dowel in a plurality offset positions to accommodate for misalignments of said tree trunk with respect to a vertical axis.

4. The self-clamping Christmas tree stand according to claim 2, wherein said stabilizer positioning dowel has a spiked shape for directly impaling the bottom of said tree trunk.

5. The self-clamping Christmas tree stand according to claim 1, wherein each of said plurality of self-clamping members further includes an upper travel stop for limiting travel of said reservoir member in an upward direction.

6. The self-clamping Christmas tree stand according to claim 1, wherein each of said plurality of self-clamping members further includes an engagement notch for maintaining said reservoir member in a clamped position.

7. The self-clamping Christmas tree stand according to claim 1, wherein said outer portion of said base member further includes a rim for capturing incidental spills of liquid.

8. The self-clamping Christmas tree stand according to claim 1, further including spring means installed inside said central portion of said base member in such a manner as to provide at least a partial counterforce to said weight applied to said reservoir member.

9. A self-clamping Christmas tree stand comprising:

a reservoir member including, (a) an opening for receiving a trunk of a tree, (b) an upper portion adapted for receiving a plurality of clamping members, (c) a lower portion for coaxially disposing said reservoir member into a base member, and (d) an interior bottom having a substantially centered stabilizer positioning dowel for positioning of a stabilizer disk, and (e) means for causing said plurality of clamping members to clamp onto said tree trunk when a weight associated with said tree is applied to said reservoir member;

said base member including, (a) a central portion adapted for coaxially receiving said lower portion of said reservoir member, and (b) an outer portion adapted for receiving said plurality of clamping members;

said plurality of clamping members, each of said plurality of clamping members including, (a) a bottom end adapted for being disposed into said outer portion of said base member, (b) a top end adapted for clamping onto said tree trunk, and (c) means for locking said reservoir member into a clamped position following application of said weight; and said stabilizer disk including;

(a) a top portion having at least one vertically standing spike for impaling a bottom of said tree trunk, and (b) a bottom portion having a plurality of indentations for adjustably coupling with said stabilizer positioning dowel in a plurality offset positions to accommodate for misalignments of said tree trunk with respect to a vertical axis.

10. A self-clamping Christmas tree stand comprising:

a reservoir member including, (a) an opening for receiving a trunk of a tree, (b) a lower piston portion for coaxially installing said reservoir member into a base member, (c) an upper flange portion having a plurality of equally spaced slots for slideably receiving therethrough a plurality of clamping members, (d) an interior bottom having a substantially centered stabilizer positioning dowel for positioning of a stabilizer disk, and (e) means for causing said plurality of clamping members to clamp onto said tree trunk when a weight associated with said tree is applied to said reservoir member;

a base member including, (a) a cylinder portion for receiving said lower piston portion of said reservoir member, (b) an outer support portion having a plurality of equally spaced pivot channels in angular alignment with said plurality of equally spaced slots and adapted for receiving said plurality of clamping members, (c) a rim located on the outer circumference of said base member for capturing incidental spills of liquid, said plurality of clamping members, each of said plurality of clamping members including, (a) a pivot end for being pivotally disposed in said pivot channels, (b) a curvilinear end having a substantially vertical face adapted for clamping onto said tree trunk, (c) an engagement notch for slideably locking said upper flange portion into a clamped position, and (d) an upper travel stop for limiting travel of said reservoir member in an upward direction; and said stabilizer disk including;

(a) a top portion having at least one vertically standing spike for impaling a bottom of said tree trunk, and (b) a bottom portion having a plurality of indentations for adjustably coupling with said stabilizer positioning dowel in a plurality offset positions to accommodate for misalignments of said tree trunk with respect to a vertical axis.

11. The self-clamping Christmas tree stand according to claim 10, wherein said Christmas tree stand has six or less component parts.

12. The self-clamping Christmas tree stand according to claim 10, wherein said reservoir member provides a liquid tight volume for providing nourishment to said tree.

13. The self-clamping Christmas tree stand according to claim 10, wherein said stabilizer disk may be trimmed using scissors to further accommodate misalignments of said tree trunk.

14. The self-clamping Christmas tree stand according to claim 10, wherein said is constructed of molded plastic or equivalent organic polymer material.

15. The self-clamping Christmas tree stand according to claim 10, wherein said cylinder portion provides lateral support to said reservoir member.

* * * * *